US011134766B2

(12) United States Patent
Hasegawa

(10) Patent No.: US 11,134,766 B2
(45) Date of Patent: Oct. 5, 2021

(54) COSMETIC CONTAINER

(71) Applicant: AMG CO., LTD., Tokyo (JP)

(72) Inventor: Hiroki Hasegawa, Tokyo (JP)

(73) Assignee: AMG CO., LTD., Tokyo (JP)

( * ) Notice: Subject to any disclaimer, the term of this patent is extended or adjusted under 35 U.S.C. 154(b) by 0 days.

(21) Appl. No.: 16/716,067

(22) Filed: Dec. 16, 2019

(65) Prior Publication Data

US 2020/0113311 A1 Apr. 16, 2020

Related U.S. Application Data

(63) Continuation of application No. 15/994,941, filed on May 31, 2018, now Pat. No. 10,506,866.

(30) Foreign Application Priority Data

Dec. 12, 2017 (JP) ..... JP2017-238112

(51) Int. Cl.
*A45D 40/26* (2006.01)
*A45D 34/04* (2006.01)

(52) U.S. Cl.
CPC ..... *A45D 40/265* (2013.01); *A45D 34/045* (2013.01); *A45D 2200/053* (2013.01)

(58) Field of Classification Search
CPC ..... A45D 40/265; A45D 34/045; A45D 2200/053; A45D 34/042; A45D 34/043; A45D 34/046; A45D 40/262; A45D 40/264; A45D 40/267; B65D 2501/0036; B65D 1/0223; B65D 2501/0081; B65D 2501/0027; B65D 2501/24063; B65D 2501/24248; B65D 2501/24777; B65D 2501/24801
USPC ..... 401/126–130; 215/216, 334; D9/529, D9/553, 561, 566; D28/4, 6
See application file for complete search history.

(56) References Cited

U.S. PATENT DOCUMENTS

| | | | | |
|---|---|---|---|---|
| 3,312,255 | A | 4/1967 | Miller | |
| 5,529,417 | A * | 6/1996 | Burrlader | A45D 34/045 132/73 |
| 7,000,790 | B1 * | 2/2006 | Bae | B65D 55/026 206/459.1 |
| 7,810,510 | B2 | 10/2010 | Tranchant | |
| 8,636,434 | B2 | 1/2014 | Tranchant et al. | |
| 8,986,236 | B2 | 3/2015 | Slokovic et al. | |

(Continued)

FOREIGN PATENT DOCUMENTS

JP 2016-222296 A 12/2016

*Primary Examiner* — David J Walczak
(74) *Attorney, Agent, or Firm* — Procopio, Cory, Hargreaves & Savitch LLP

(57) ABSTRACT

A cosmetics container having enhanced structural strength regardless of exterior container shape is provided. In the container body of the cosmetic container, the right side wall part and the left side wall part defined by the shape of the inside of the container body are configured to have a thickness in the main body upper portion that is thicker than the thickness in the main body middle portion. Also, the front wall part and the back wall part defined by the shape of the inside of the container body are configured such that in the main body lower portion. Additionally, the portions connecting sideways with the right side wall part and the left side wall part are thinner than in the central portion.

17 Claims, 19 Drawing Sheets

(56) References Cited

U.S. PATENT DOCUMENTS

| | | | | |
|---|---|---|---|---|
| 8,998,012 | B2 * | 4/2015 | Bailey | B65D 41/0471 215/321 |
| D755,057 | S * | 5/2016 | Mutter | D9/529 |
| 2002/0050482 | A1 * | 5/2002 | Kamdar | B65D 1/0223 215/379 |
| 2007/0231050 | A1 * | 10/2007 | Thiebaut | A45D 34/045 401/121 |

* cited by examiner

COSMETIC CONTAINER

RELATED APPLICATION

The present application is a continuation of U.S. Ser. No. 15/994,941 filed 31 May 2018, granted as U.S. Pat. No. 10,506,866, which claims priority to Japanese patent application no. JP2017-238112 filed 12 Dec. 2017, which is incorporated herein by reference in its entirety.

BACKGROUND

Field of the Invention

The present invention relates to a cosmetics container.

Related Art

Conventionally, cosmetics containers manufactured from resin material through blow molding which are used to hold liquid cosmetics such as lip gloss are known (e.g., Patent Document 1).

CITATION LIST

Patent Literature

Patent Document 1: JP 2016-222296 A

As illustrated in FIG. 1 of Patent Document 1, conventionally, the wall thickness of containers manufactured through blow molding is substantially consistent at all locations throughout the container. As a result, in order to enhance structural strength of a container, it was necessary to adjust the exterior container shape such as by forming convex/concave contours.

Taking the above into consideration, the present invention provides a cosmetics container which is able to have enhanced structural strength regardless of exterior container shape.

SUMMARY

The first invention is a cosmetics container comprising: a container body which holds cosmetic material; and a cap which engages with the container body, in which the container body includes: a main body screw portion which engages with the cap; a main body upper portion formed continuously below the main body screw portion; a main body middle portion formed continuously below the main body upper portion; and a main body lower portion formed continuously below the main body middle portion, the main body upper portion, the main body middle portion and the main body lower portion form a front wall part, a back wall part, a right side wall part, a left side wall part, and a bottom wall part, which collectively form a space which holds the cosmetic material, the right side wall part and the left side wall part defined by the shape of the inside of the container body are formed such that the thickness at the main body upper portion is thicker than the thickness at the main body middle portion, the front wall part and the back wall part defined by the shape of the inside of the container body in the main body lower portion are formed such that portions connecting sideways to the right side wall part and the left side wall part are thinner than in the central portions, and connecting portions between the front wall part and the right side wall part and the left side wall part and connecting portions between the back wall part and the right side wall part and the left side wall part in the inner surface of the main body lower portion are formed as curved surfaces.

The main body upper portion is the portion the user grips to remove and connect the cap and requires structural strength. The main body lower portion is the portion in contact with the table top when placing the cosmetics container on a surface such as a dressing table and again requires structural strength. According to the configuration of the first invention, the thickness of the right side wall part and the left side wall part of the main body upper portion is thicker than in the main body middle portion to enhance the structural strength. Structural strength is enhanced in the main body lower portion inner surfaces through the configuration of the front wall part and the like thereat being configured as curved surfaces. In addition, since strength is enhanced through a wall thickness defined by the shape of the inner wall, there is no need to create unevenness in the exterior of the cosmetics container. In other words, structural strength is enhanced regardless of the exterior container shape.

The second invention is a cosmetics container configured according to the first invention, in which the cosmetics container is formed such that the area of the front wall part and the back wall part is greater than the area of the right side wall part and the left side wall part; formed in the shape of an isosceles triangle with rounded corners having, in a front view, the uppermost portion of the cap as the apex and the bottom wall as the bottom edge; is formed of a material where at least the container body has light permeability; is configured such that the thickness of the right side wall part and the left side wall part gradually becomes thinner from a position on the main body screw portion towards a position on the main body middle portion; and configured such that in a front view, the main body lower portion is formed in a bow shape and configured such that the curvature radius of the inner surface is smaller than the curvature radius of the outer surface and gradually becomes thicker from a position on the main body middle portion towards the lowermost portion of the main body lower portion.

The configuration of the second invention is such that an optical effect is exhibited through a predetermined bow shape in the main body lower portion and causes a visual effect to be viewed by the user. In other words, since the main body lower portion is formed so that the inner surface curvature radius is smaller than the outer surface curvature radius, and configured to be gradually thicker towards the lowermost portion of the main body lower portion, an optical effect is exhibited similar to that of a concave meniscus lens, such that the image of the cosmetic material held inside refracts and is externally projected. Also, since the shape of the container body in the front view is different from that in the side view, the image of the cosmetic material viewed in the eye of the user changes as focus is shifted from the front view to the side view. As a result, visual stimulation is provided to the user through the visual changes as the cosmetics container is used to apply makeup.

The third invention is a cosmetics container configured according to the second invention, in which the thickness of the right side wall part and the left side wall part is configured so as to become thinner as it approaches the main body lower portion and has, in the main body middle portion, a thinning increase position where the rate at which the thickness of the right side wall part and the left side wall part becomes thinner increases; boundary portions between the main body middle portion and the main body lower portion are formed as thinmost portions where wall thickness is at its thinnest in the container body; and the inner surface and the outer surface of the thinmost portions are formed as curved surfaces.

According to the configuration of the third invention, since the curvature radius of the curved surface inside the container body becomes smaller through of the thinning increase position, it naturally connects to the curved surface of the inner surface of the main body lower portion. As a result, when a cosmetic material is held in the cosmetics container, it appears as having a natural curvilinear outline and, furthermore, in boundary portions, the optical effect can be exhibited to greater effect. Moreover, sufficient strength can be obtained in the thinnest portions since the inner surface and outer surface are formed as curved surfaces.

The present invention provides a cosmetics container which is able to have enhanced structural strength regardless of exterior container shape.

DETAILED DESCRIPTION

Figure 1:
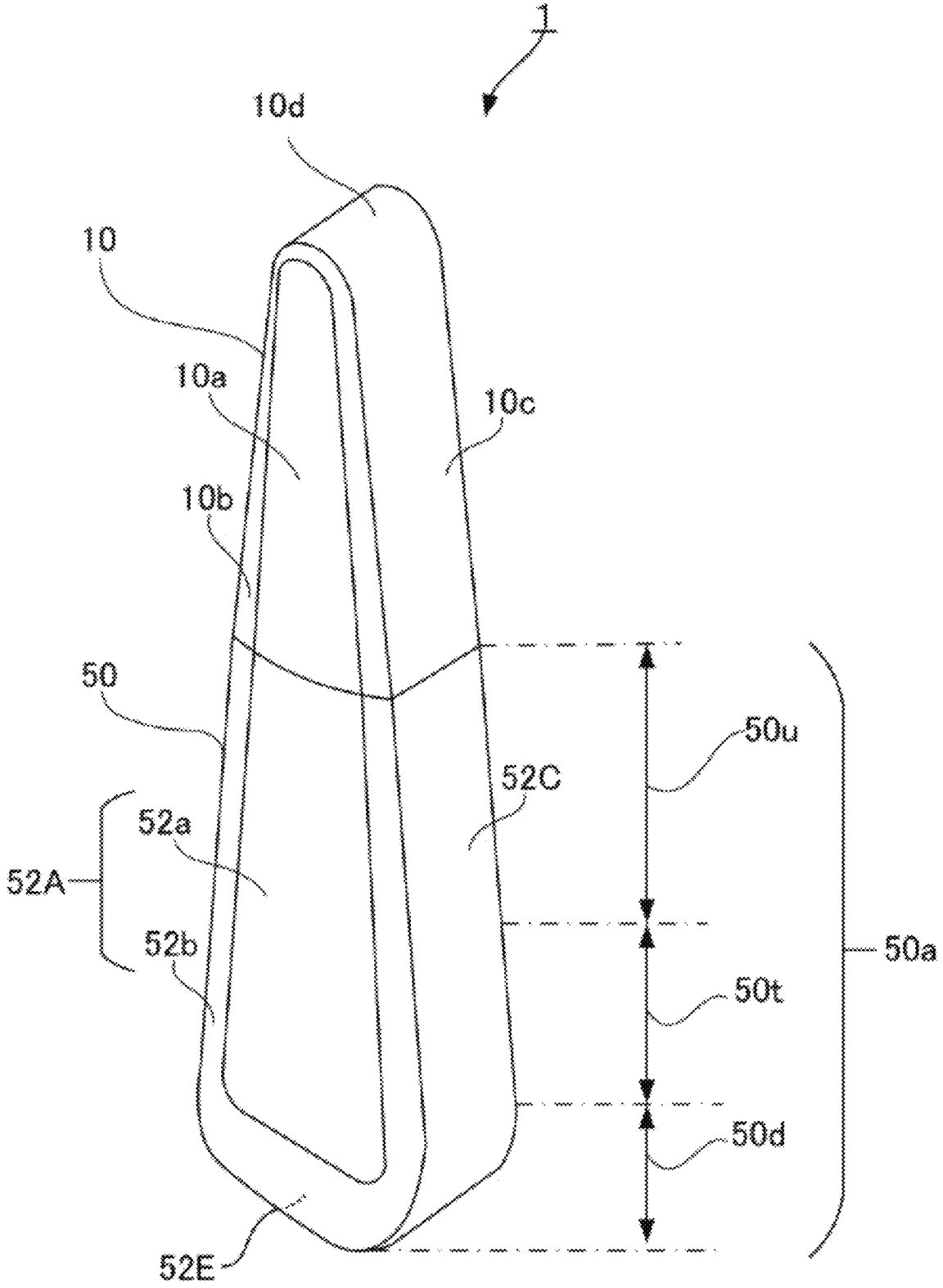
FIG. 1 is a schematic perspective view of a cosmetics container according to an embodiment of the present invention.

Preferred embodiments of the present invention will be described below with reference to the drawings. As illustrated in FIG. 1, a cosmetics container 1 (hereinafter, referred to as "container 1") includes a cap 10 and a cosmetics container main body 50 (hereinafter, referred to as "container body 50"). The container body 50 is an example of a container body. The cap 10 is an example of a cap. The cap 10 detachably engages with the container body 50 via a screw. The container body 50 and the cap 10 are formed via injection blow molding using a light permeable material. The light permeable material may be, for example, polyethylene terephthalate (PET) resin. Note that the light permeable material may be a transparent material; it may also be a translucent material.

The container body 50 holds liquid cosmetic material such as lip gloss, mascara or liquid foundation. In the present specification, the direction in which the cap 10 is positioned is referred to as upper (upward) and the direction in which the container body 50 is positioned is referred to as lower (downward). The higher the location on the upper side is expressed as "higher position"; the lower the location on the lower side as "lower position". The internal portion of the container body 50 is referred to as "inside"; the external portion as "outside". The surface of the page facing up towards the reader is referred to as the "front side"; the reverse side as the "back side". The directions orthogonal to the inside or back side, as viewed from the front side of the page, are referred to as "left side" and "right side".

As illustrated in FIG. 1, the container 1 is formed in a flat shape in which the area of a front wall part 52A is greater than the area of a right side wall part 52C. The relationship is also the same between the area of a back wall part 52B and that of a left side wall part 52C (see FIG. 8 and the like). In addition, in a front view, the container 1 is formed in an isosceles triangular shape with rounded corners having the uppermost portion 10*d* of the cap 10 as the apex and a bottom wall part 52E as the bottom edge. The container 1 is formed in a symmetrical shape in both the front-back direction and the left-right direction, and a perspective view from the back side opposite to that of FIG. 1 is the same as FIG. 1. The shape of a container 1 in a side view is a rectangular shape with rounded corners (see FIG. 17).

The front face portion 10*a* of the cap 10 is flat and is connected to the side face portion 10*c* via the curved face portion 10*b*. Similarly, the front face portion 52*a* of the container body 50 is flat and connected to the side face portion 52*c* via the curved face portion 52*b*.

Figure 2:
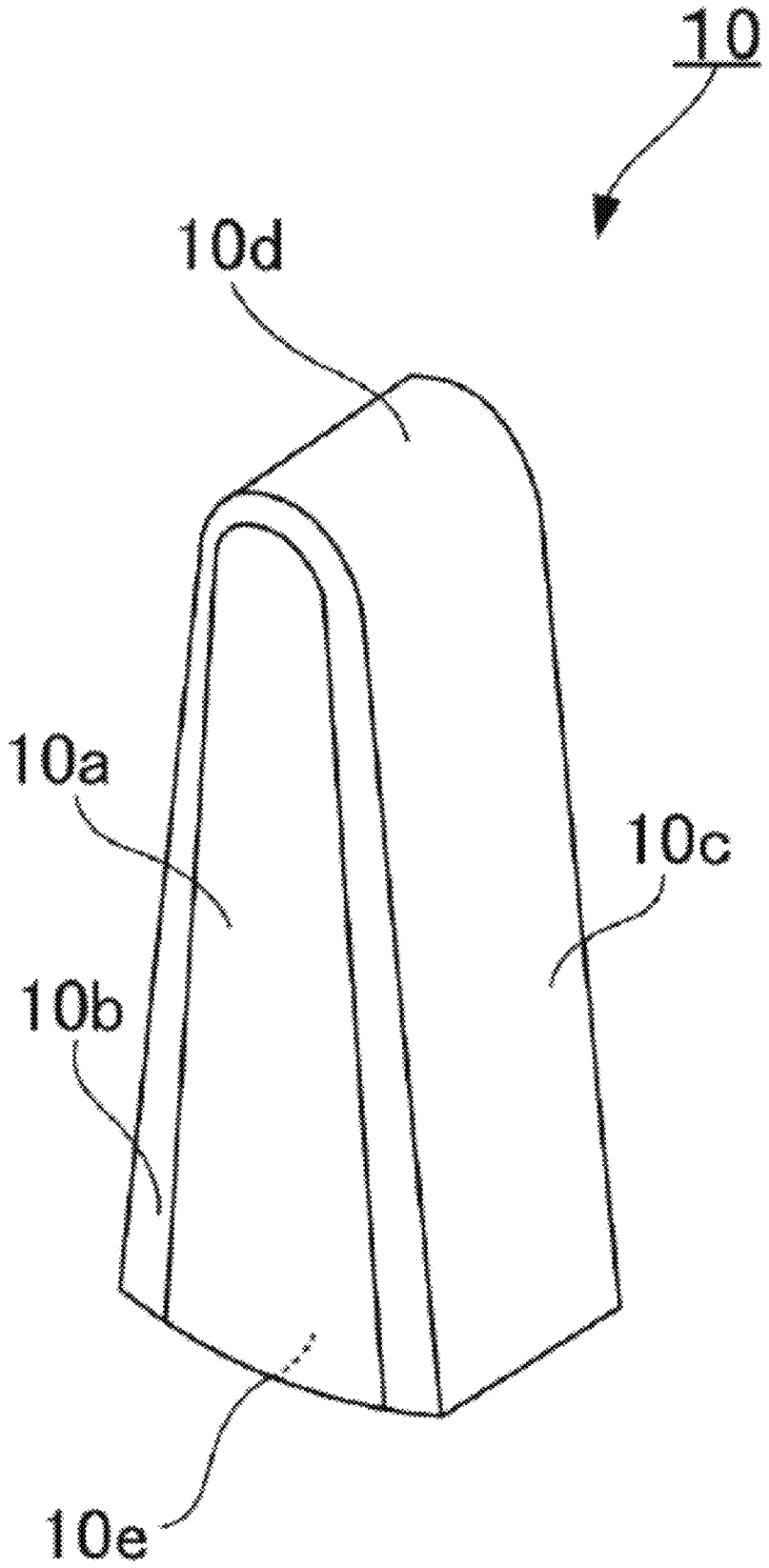
FIG. 2 is a schematic perspective view of a cap.
Figure 3:
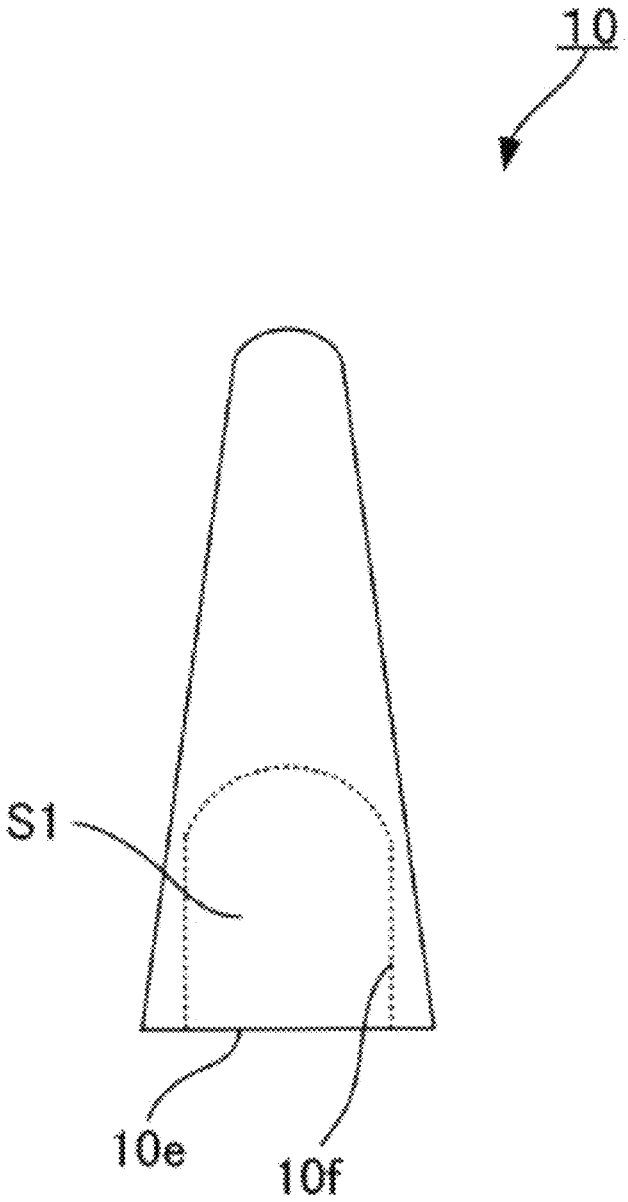
FIG. 3 is a schematic view illustrating the inside of a cap.

As illustrated in FIGS. 2 and 3, an opening portion is formed in the bottom portion 10*e* of the cap 10, and a space S1 (see FIG. 3) is formed continuous to the opening portion. An inner cap 20, illustrated in FIG. 4, is fixed to the inner surface of the space S1.

Figure 4:
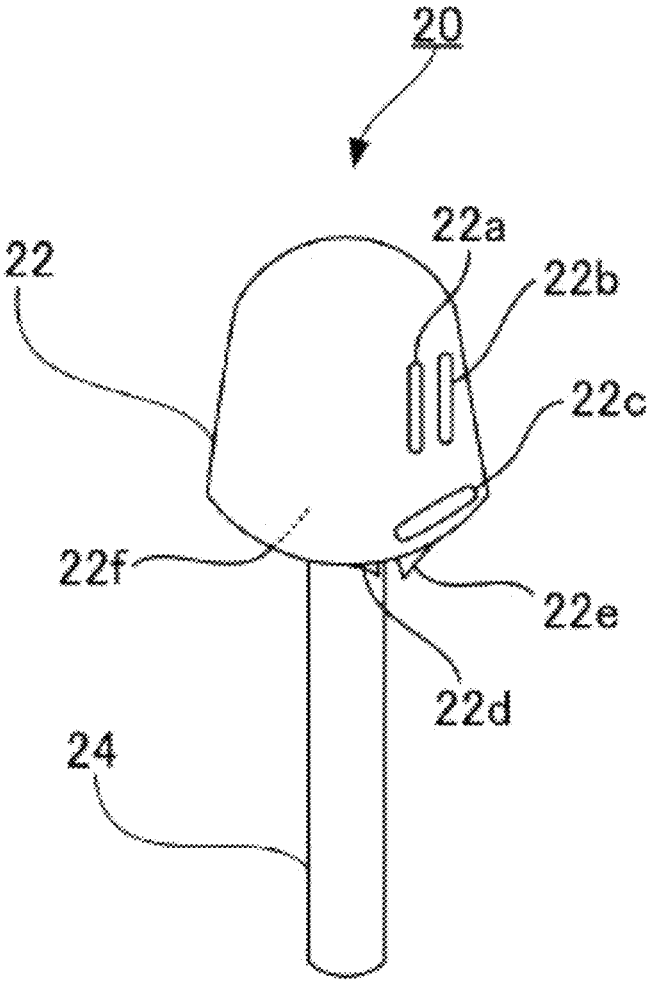
FIG. 4 is a schematic perspective view illustrating an inner cap.
Figure 5:
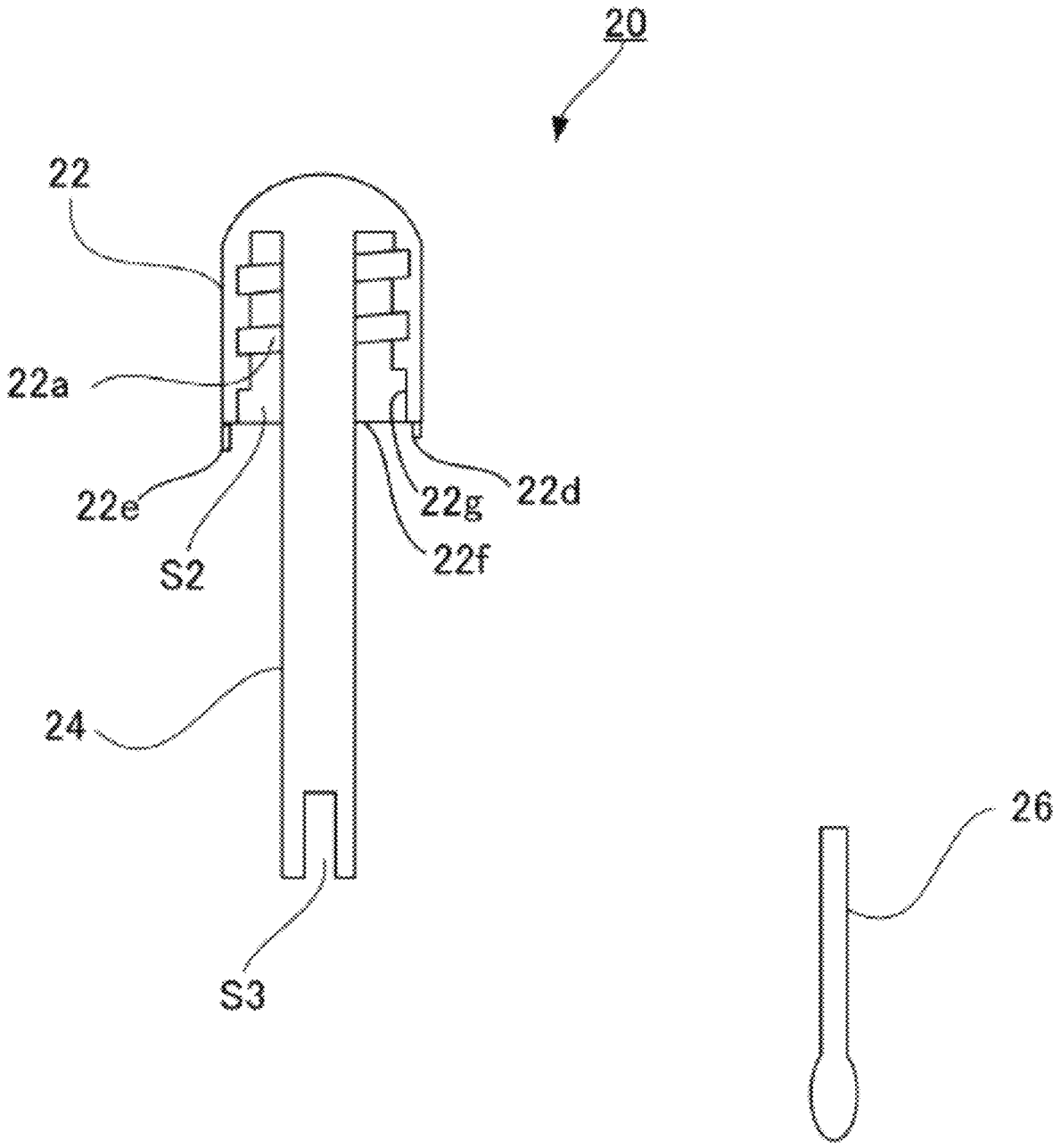
FIG. 5 is a schematic view illustrating the inner portions of the inner cap.

As illustrated in FIG. 4, the outer surface 22 of the inner cap 20 includes vertically elongated protrusions 22*a* and 22*b* and one or more horizontally elongated protrusions 22*c*, and is formed so as to allow engagement with grooves (not illustrated) formed in the inner wall 10*f* of the space S1 of the cap 10. As illustrated in FIG. 5, an opening portion is formed in the bottom portion 22*f* of the inner cap 20, and a space S2 is formed continuous to the opening portion. A female screw 22*a* is formed in the inner wall 22*g* of the space S2.

As illustrated in FIGS. 4 and 5, inclined projections 22*e* and 22*d* are formed in the outer bottom surface of the bottom portion 22*f* of the inner cap 20. A latching projection 52*i* (see FIG. 6) of the container body 50 detachably engages between the inclined projections 22*e* and 22*d* (see FIG. 4).

Figure 6:
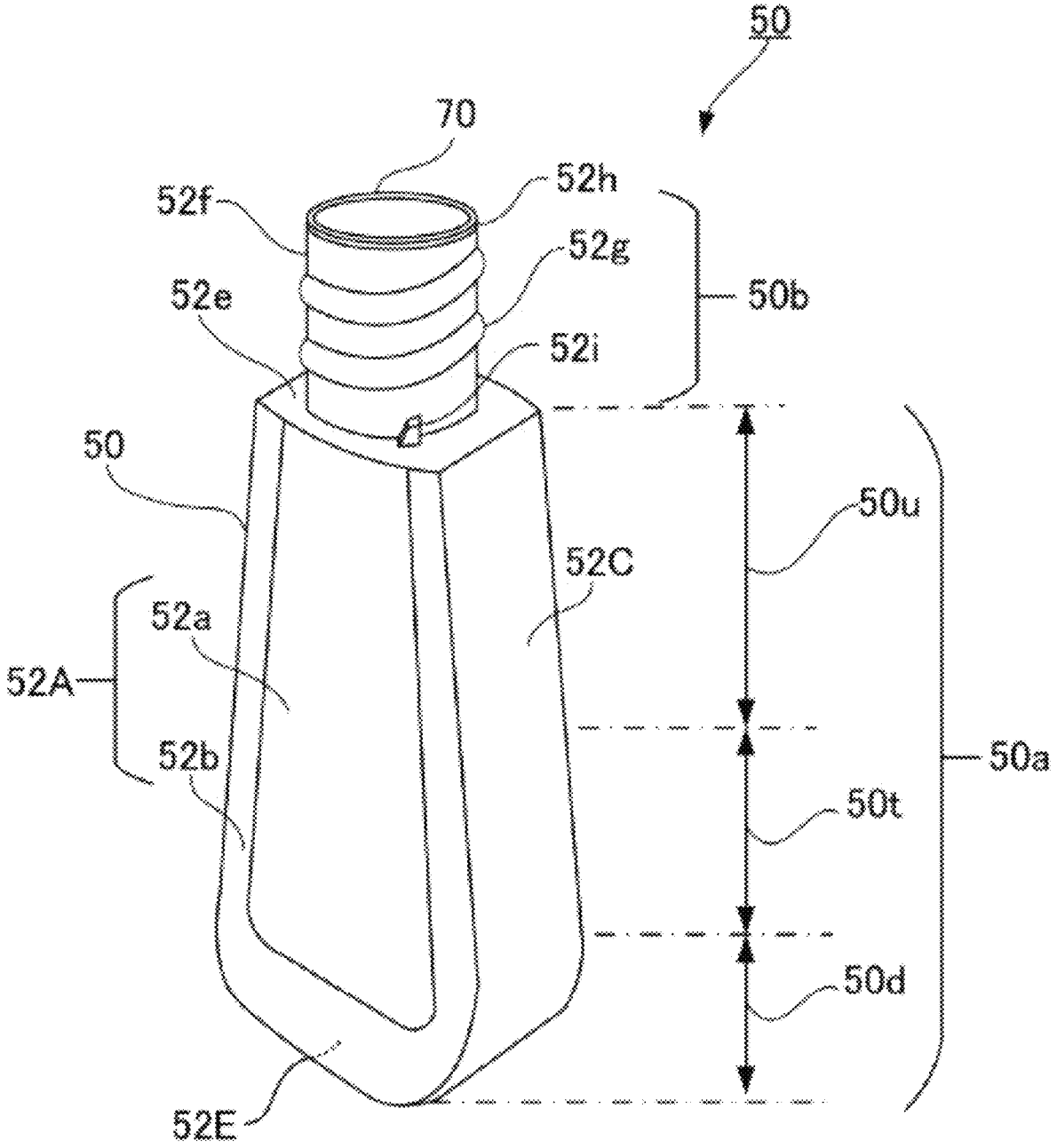
FIG. 6 is a schematic perspective view illustrating the container body.

As illustrated in FIG. 6, the container body 50 includes a main body portion 50*a* and a main body screw portion 50*b*. The main body screw portion 50*b* engages with the cap 10. The main body portion 50*a* includes a main body upper portion 50*u* continuously formed below the main body screw portion 50*b*, a main body middle portion 50*t* continuously formed below the main body upper portion 50*u*, and a main body lower portion 50*d* continuously formed below the main body middle portion 50*t*. The main body upper portion 50*u*, the main body middle portion 50*t* and the main body lower portion 50*d* form a front wall part 52A, a back wall part 52B, a right side wall part 52C, a left side wall part 52D, and a bottom wall part 52E, which collectively form a space S4 (see FIG. 13) which holds the cosmetic material 100 (see FIGS. 13, 16 to 19) (see FIGS. 7 to 9).

Main body screw portion 50*b* includes a cylinder portion 52*f* and a male screw 52*g* which is formed on the cylinder portion 52*f*. A cylinder-shaped packing 70 (see FIGS. 10 and 11) is disposed inside the cylinder portion 52*f*. The latching projection 52*i* is formed in contact with the shoulder portion 52*e* of the main body portion 50*a* and the cylinder portion 52*f*.

Figure 10:
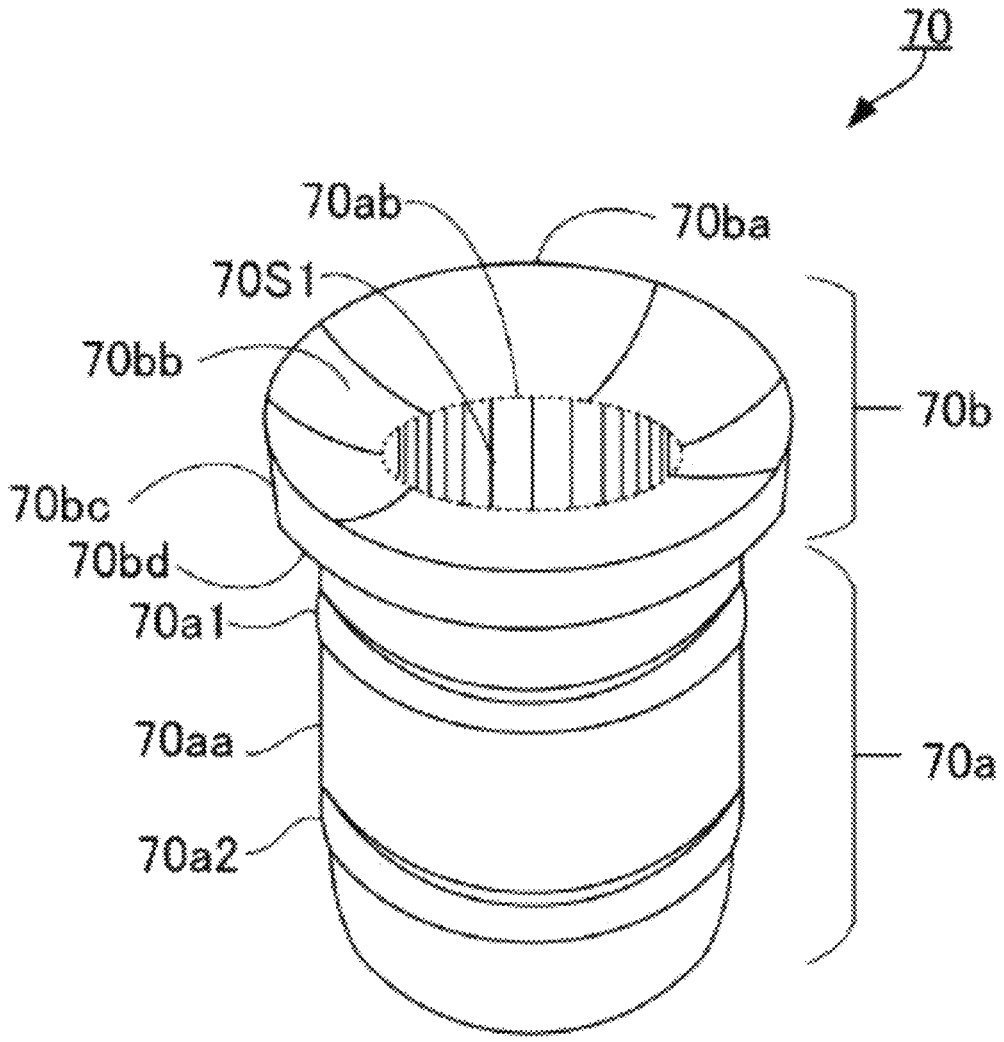
FIG. 10 is a schematic perspective view illustrating the packing.
Figure 11:
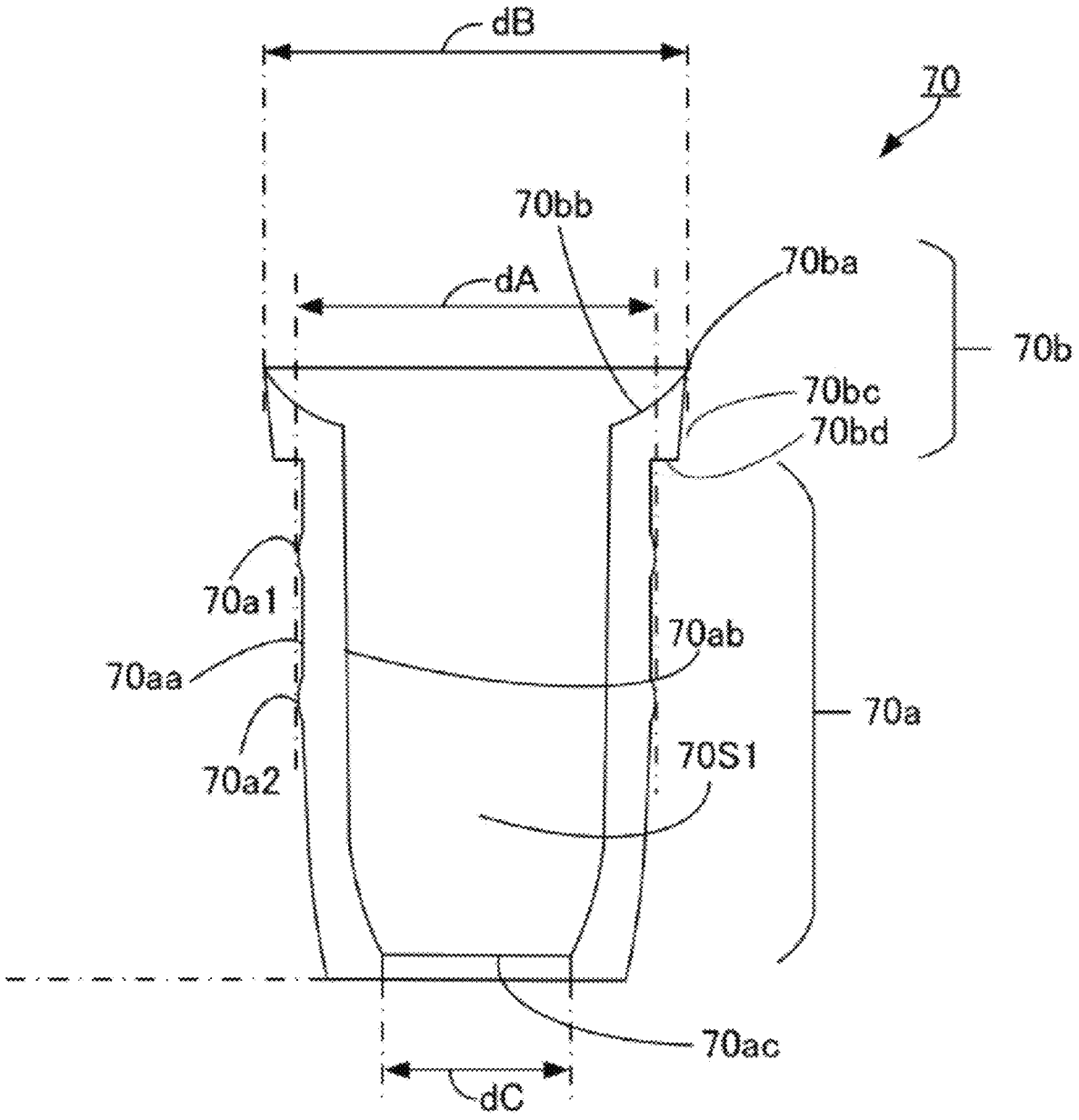
FIG. 11 is schematic cross-sectional views of the packing.

The packing 70 will now be described. As illustrated in FIGS. 10 and 11, the packing 70 is formed in a generally cylindrical shape and includes a packing main body portion 70*a* and a diametrical expansion portion 70*b*. The packing main body portion 70*a* is an example of a packing main body portion. Annular protrusions 70*a*1 and 70*a*2 are formed on the outer circumferential surface 70*aa* of the packing main body portion 70*a* to facilitate attachment thereof to the inside of the cylinder portion 52*f*.

The diametrical expansion portion 70*b* includes an upper end portion (opening end portion) 70*ba*, a slope portion 70*bb*, an external slope portion 70*bc*, and a lower end portion 70*bd*. The upper end portion 70*ba* is an example of an opening end portion. The slope portion 70*bb* is an example of a slope portion.

The packing 70 is formed in a cylindrical shape in which the diameter of the upper end portion 70*ba* is greater than the diameter of the outer circumferential surface of the packing main body portion 70*a*. The slope portion 70*bb* is configured such that its diameter gradually expands in a concentrically radiating fashion from the entrance portion 70*ab* of the space 70S1 within the packing main body portion 70*a* towards the upper end portion 70*ba*. The terminal end portion of the slope portion 70*bb* is the upper end portion 70*ba*.

The upper end portion 70*ba* is disposed further outward than the outer surface (outer circumferential surface 70*aa*) of the wall portion configuring the packing main body portion 70*a* (see FIG. 11). In other words, the diameter dB of the upper end portion 70*ba* is greater than the maximum diameter dA of the outer circumferential surface 70*aa* of the packing main body portion 70*a*.

The packing 70 is formed from a flexible resin material. The flexible resin material may, for example, be polyethylene. When the cap 10 and the container body 50 are engaged with each other, the packing 70 is pressed against the vicinity of the ceiling of the space S2 of the inner cap 20 (see FIG. 5) to form a tight seal. This allows the cosmetic material 100 to be isolated from the outside and securely held within the container body 50.

The diameter dC of the lower opening portion 70*ac* of the packing 70 is slightly smaller than the diameter of the brush 26. As a result, when the brush 26 to which the cosmetic material adheres is withdrawn from the packing 70, any excessive cosmetic material is caused to drop off by the lower opening portion 70*ac* of the packing 70. In other words, the lower opening portion 70*ac* is an example of an adjustment mechanism for regulating the volume of cosmetic material adhering to the brush 26.

As the packing 70 is pushed into the cylinder portion 52*f*, the outer circumferential surface 70*aa* of the packing 70 comes into contact with the inner circumferential surface of cylinder portion 52*f* and is fixed. The packing 70 is fixed to the cylinder portion 52*f* in a state in which the lower end portion 70*bd* of the diametrical expansion portion 70*b* of the packing 70 is in contact with the opening end portion 52*h* of the cylinder portion 52*f*.

A feature of the container 1 is that the thickness and shape of the walls can be prescribed through its inner shape regardless of its external shape, thereby enhancing structural strength. In addition, by combining a plurality of kinds of lens-like shapes, an optical effect is exhibited to provide visual stimulation to the user. The feature of the container 1 is now described in detail.

Figure 7:
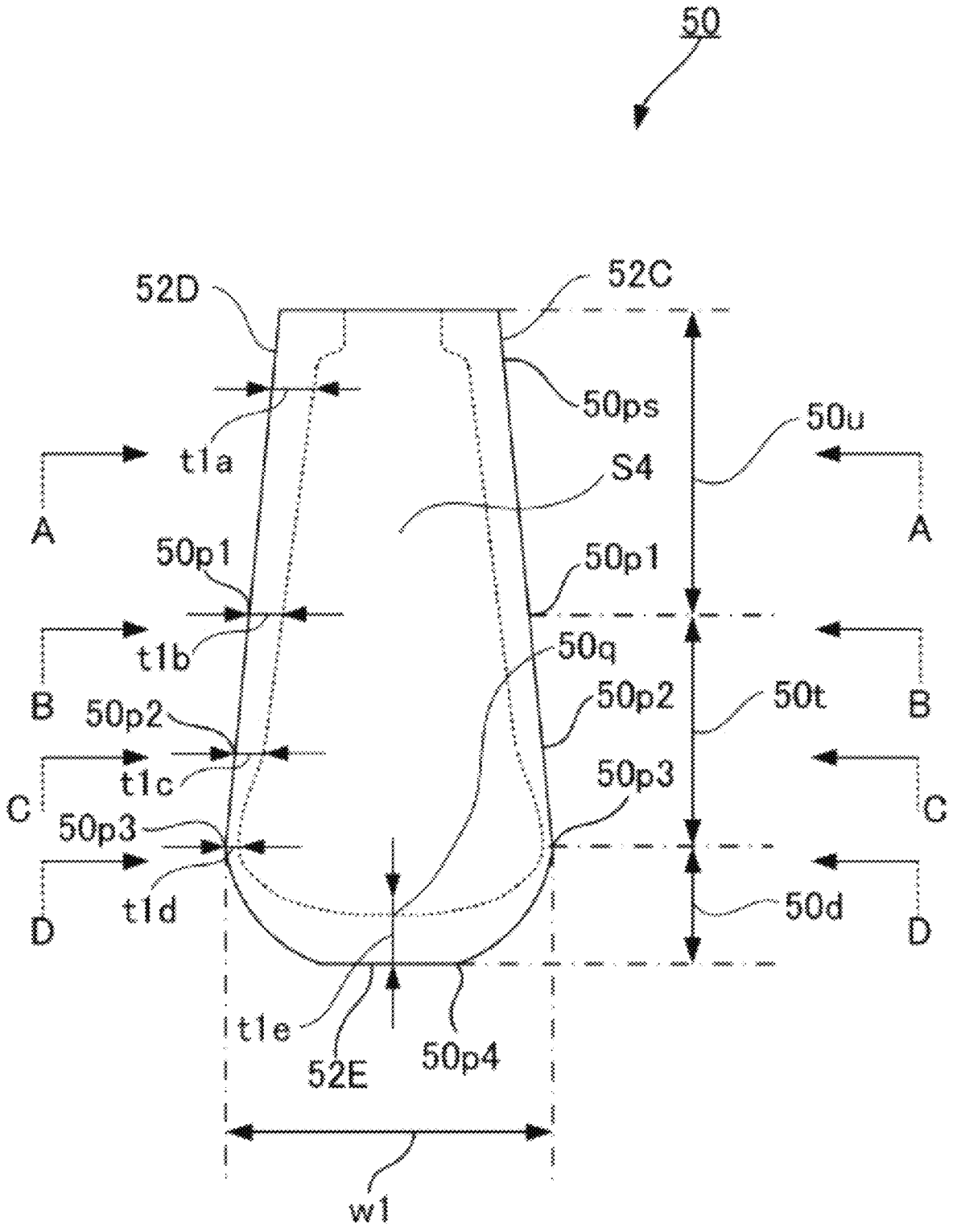
FIG. 7 is a schematic front view illustrating the inside of the container body.

FIG. 7 illustrates the inside of the main body portion 50*a* of the container body 50. The thickness of the right side wall part 52C and the left side wall part 52D is configured so as to become gradually thinner from the position of the main body screw portion 50*b* side (see FIG. 6) to the position of the main body middle portion 50*t* side, so that the thickness at the main body upper portion 50*u* is greater than the thickness at the main body middle portion 50*t*. As a result, the structural strength of the main body upper portion 50*u* is enhanced.

As described above, the outer shape of the container 1 in a front view is formed in an isosceles triangular shape with rounded corners, in which wall thickness is defined by the internal shape of the container body 50. This means that the external shape and internal shape of the container body 50 are not similarly shaped, and the same applies for the main body middle portion 50*t* and the main body lower portion 50*d*.

The thickness t1*a* of the left side wall portion 52D (52C) on the main body screw portion 50*b* side is formed thicker than the thickness t1*b* of the wall at the boundary portion 50*p*1 between the main body upper portion 50*u* and the main body middle portion 50*t*.

As illustrated in FIG. 7, the thickness t1*e* of the wall of the lowermost portion of the main body lower portion 50*d* is formed thicker than the thickness of the wall on the main body middle portion 50*t* side (the position 50*p*3 side, described later). As a result, the structural strength of the main body lower portion 50*d* is enhanced.

In addition, the main body lower portion 50*d* is formed as a bow-shaped portion in which the curvature radius of the inner surface is smaller than the curvature radius of the outer surface and configured so as to gradually become thicker from the position of the main body middle portion 50*t* to the lowermost portion of the main body lower portion 50*d*. In other words, between the boundary portion 50*p*3 of the main body middle portion 50*t* and the main body lower portion 50*d* and the position 50*p*4 where the flat shape of the bottom wall part 52E begins, there is formed a shape similar to a concave meniscus lens.

Figure 8:
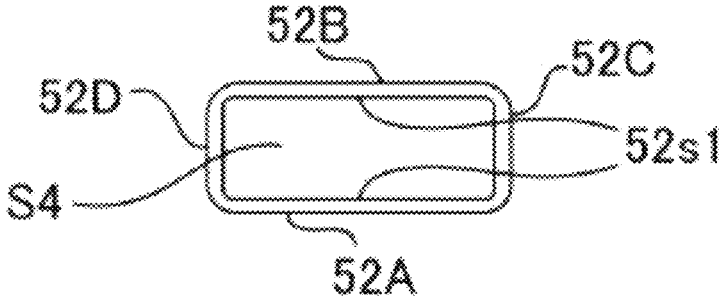
FIGS. 8(*a*)-8(*d*) are schematic cross-sectional views of the container body.
Figure 8:
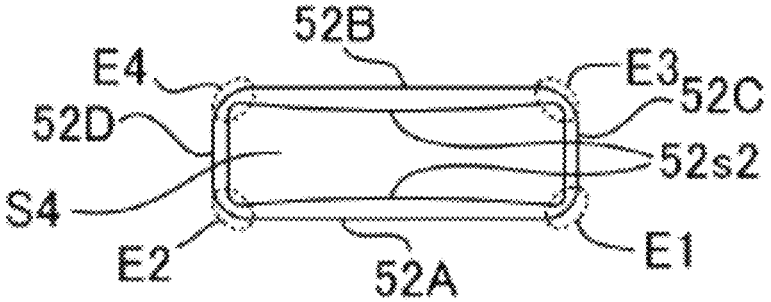
Figure 8:
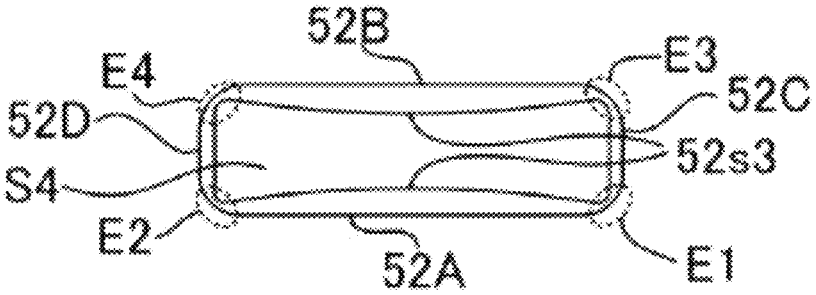
Figure 8:
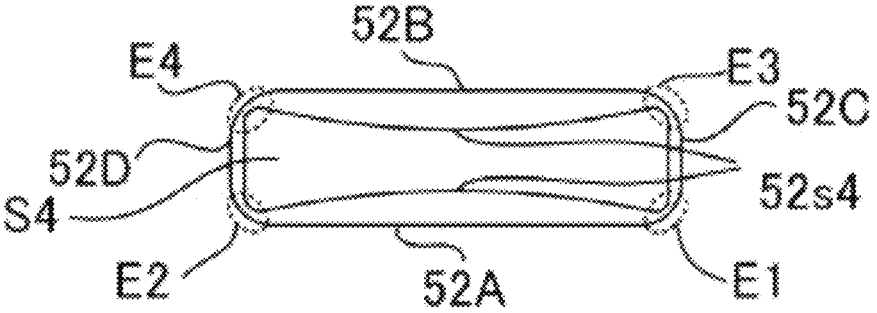

FIG. 8 is a schematic cross-sectional view of the container body 50 of FIG. 7 along line A-A (FIG. 8(*a*)), a schematic cross-sectional view along line B-B (FIG. 8(*b*)), a schematic cross-sectional view along line C-C (FIG. 8(*c*)), and a schematic cross-sectional view along line D-D (FIG. 8(*d*)). The inner surfaces 52*s*1 of the front wall part 52A and the back wall part 52B in the cross-section of the main body upper portion 50*u* are flat. However, the inner surfaces 52*s*2 and 52*s*3 of the main body middle portion 50*t* as well as the inner surfaces 52*s*4 of the main body lower portion 50*d* are configured thinner at the side portions connecting the right side wall part 52C and the left side wall part 52D than the central portion. In other words, inner surfaces 52*s*2 and 52*s*3 of the main body middle portion 50*t* as well as the inner surfaces 52$s$4 of the main body lower portion 50$d$ are convex curved surfaces facing inward. As a result, the structural strength of the main body middle portion 50$t$ and the main body lower portion 50$d$ is enhanced.

The inner surfaces 52$s$2 and 52$s$3 of the main body middle portion 50$t$, as well as the inner surfaces 52$s$4 of the main body lower portion 50$d$ have the connecting portions E1 and E2 between the front wall part 52A and the right side wall part 52C and the left side wall part 52D, respectively, as well as the connecting portions E3 and E4 between the back wall part 52B and the right side wall part 52C and the left side wall part 52D configured as concave curved surfaces. Furthermore, in the four corner parts E1 to E4, the curvature radius of the inner surface is configured smaller than the curvature radius of the outer surface. As a result, a concave meniscus lens-like shape is formed. With this shape, the image of cosmetic material 100 held inside is diffused laterally from the front surface and back surface to form an image as if the right side wall part 52C and left side wall part 52D did not exist (see FIG. 16). In one embodiment, the front wall part 52A and the back wall part 52B defined by a shape of an inside of the container body 50 are formed such that degree of the main body middle part being thicker than the portions connecting sideways to the right side wall part 52C and the left side wall part 52D is configured so as to become bigger as it approaches the main body lower portion 50D.

In both the front view (see FIG. 7) and the side view (see FIG. 9), the inner surface of the main body lower portion 50$d$ is formed as a curved surface except for at the center of the lowermost portion 50$q$. In other words, in both the front view and the side view, from the position 50$p$3 to the position 50$p$4, it is formed as a curved surface.

As illustrated in FIG. 7, the thickness of right side wall part 52C and left side wall part 52D is configured such that it becomes thinner approaching the main body lower portion 50$d$, and moreover, a thinning rate increase position 50$p$2 (hereinafter, also referred to as "position 50$p$2") is formed where the rate at which the thickness of the wall of main body middle portion 50$t$ becomes thinner increases. In the main body upper portion 50$u$ and the main body middle portion 50$t$, the rate at which the walls become thinner is steady heading downward, but at the position 50$p$2, there is a change in the rate of thinning and the rate of thinning increases. This allows a curved surface to be formed integral to the curved surface forming the inner surface of the main body lower portion 50$d$ so that when the cosmetic material 100 is held in the container 1, it appears to the user as a naturally curved image.

The boundary portion 50$p$3 between the main body middle portion 50$t$ and the main body lower portion 50$d$ (hereinafter, also referred to as "position 50$p$3") is formed as the thinnest portion of the container body 50 where the wall thickness of right side wall part 52C and left side wall part 52D is thinnest. The thickness in the thinnest portions is thickness t1$d$. The inner and outer surfaces of the portion centered on the position 50$p$3 (the position between the positions 50$p$2 and 50$p$4) are formed as curved surfaces. The curvature radius of the curved surface of the inner surface is smaller than the curvature radius of the curved surface of the outer surface. In other words, the outer surface is nearly flat and, relative to the curved surface of the inner surface, forms a concave meniscus lens-like shape. The difference in curvature radius in the portion from the position 50$p$3 to the position 50$p$4 is larger. As a result, an optical effect similar to a concave meniscus lens is exhibited when the image of the cosmetic material held internally is projected externally, and this effect becomes noticeable in the portion from the position 50$p$3 to the position 50$p$4.

Figure 9:
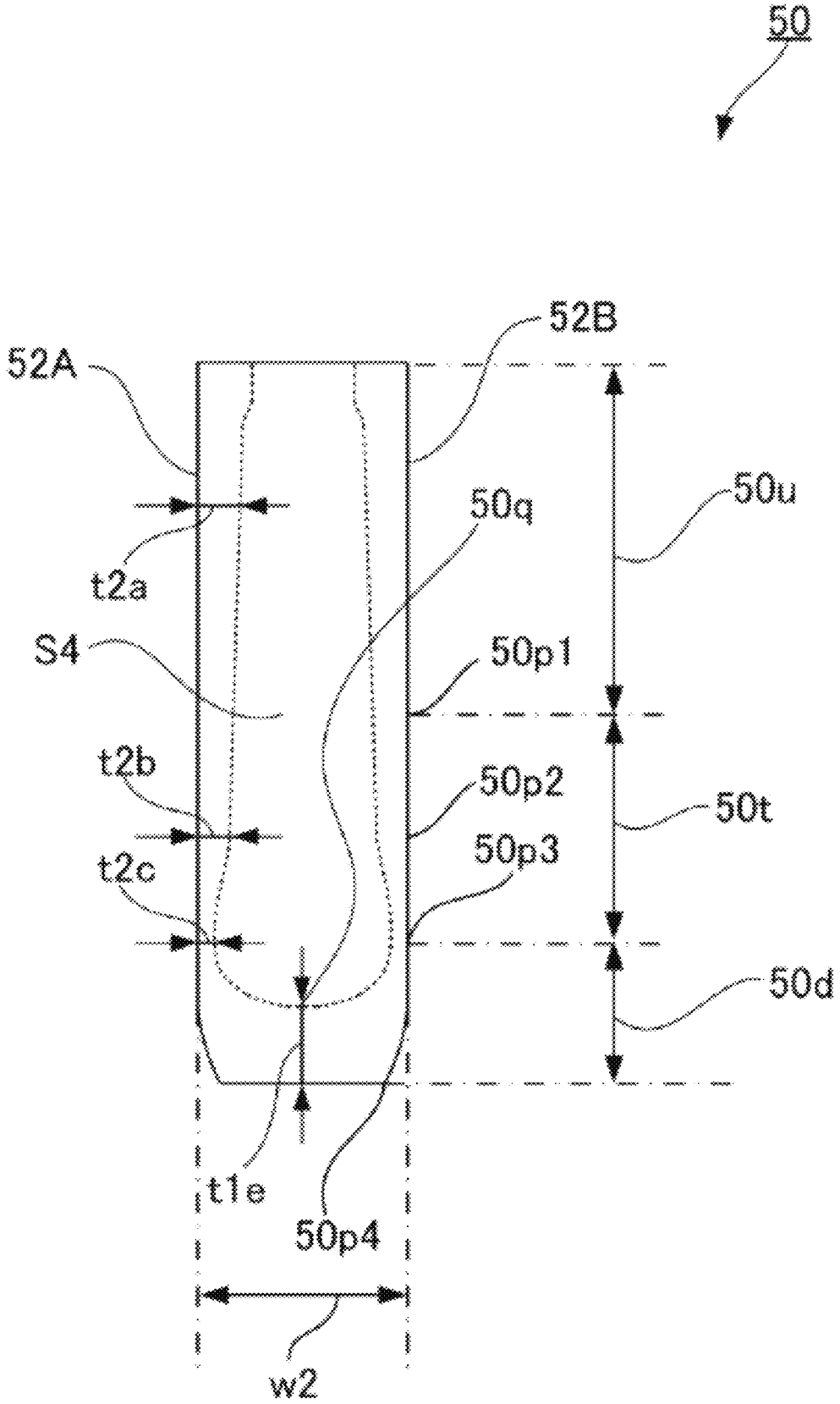
FIG. 9 is a schematic side view illustrating the inside of the container body.

FIG. 9 is a cross-sectional view of the main body portion 50$a$ of the container body 50 in a side view. As illustrated in FIG. 9, the thicknesses of the walls of the front wall part 52A and the back wall part 52B gradually becomes thinner from the main body upper portion 50$u$ to the position 50$p$2 of the main body middle portion 50$t$ so that the thickness t2$a$ in the portion of the main body upper portion 50$u$ is thicker than the thickness t2$b$ in the portion of the main body middle portion 50$t$. Also, between the position 50$p$2 and the position 50$p$3 of the main body middle portion 50$t$, the inner surface of the front wall part 52A and the back wall part 52B forms a concave curved surface, and the wall thickness t2$c$ at the position 50$p$3 is the thinnest. The inner surface of the main body lower portion 50$d$ forms a curved surface from the position 50$p$3 to the position 50$p$4 of the main body lower portion 50$d$.

Figure 12:
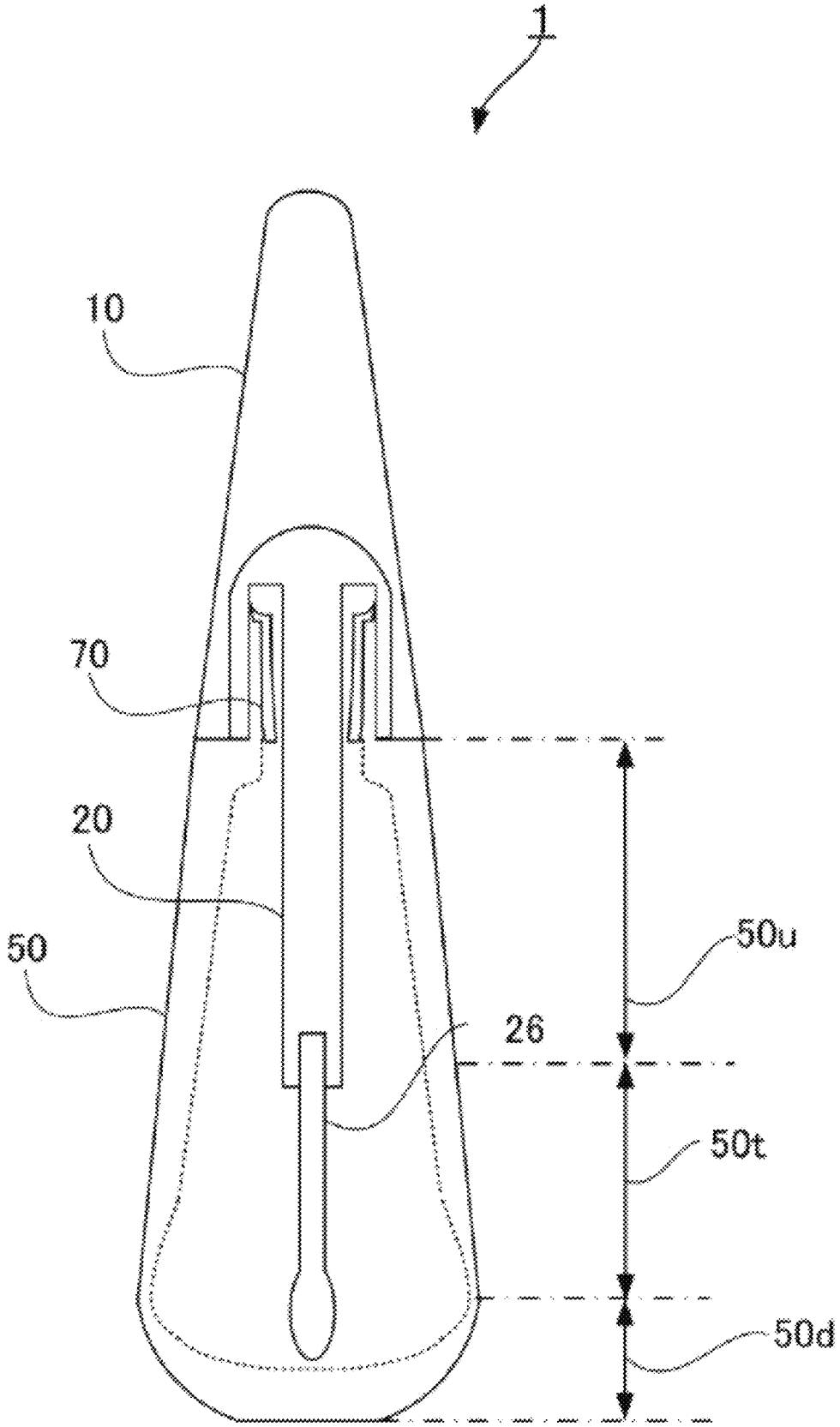
FIG. 12 is a schematic front view of the inside of the cosmetics container.

In the container 1, the cap 10, the container body 50, the packing 70 and the inner cap 20 configured as described above are disposed as illustrated in FIG. 12.

Figure 13:
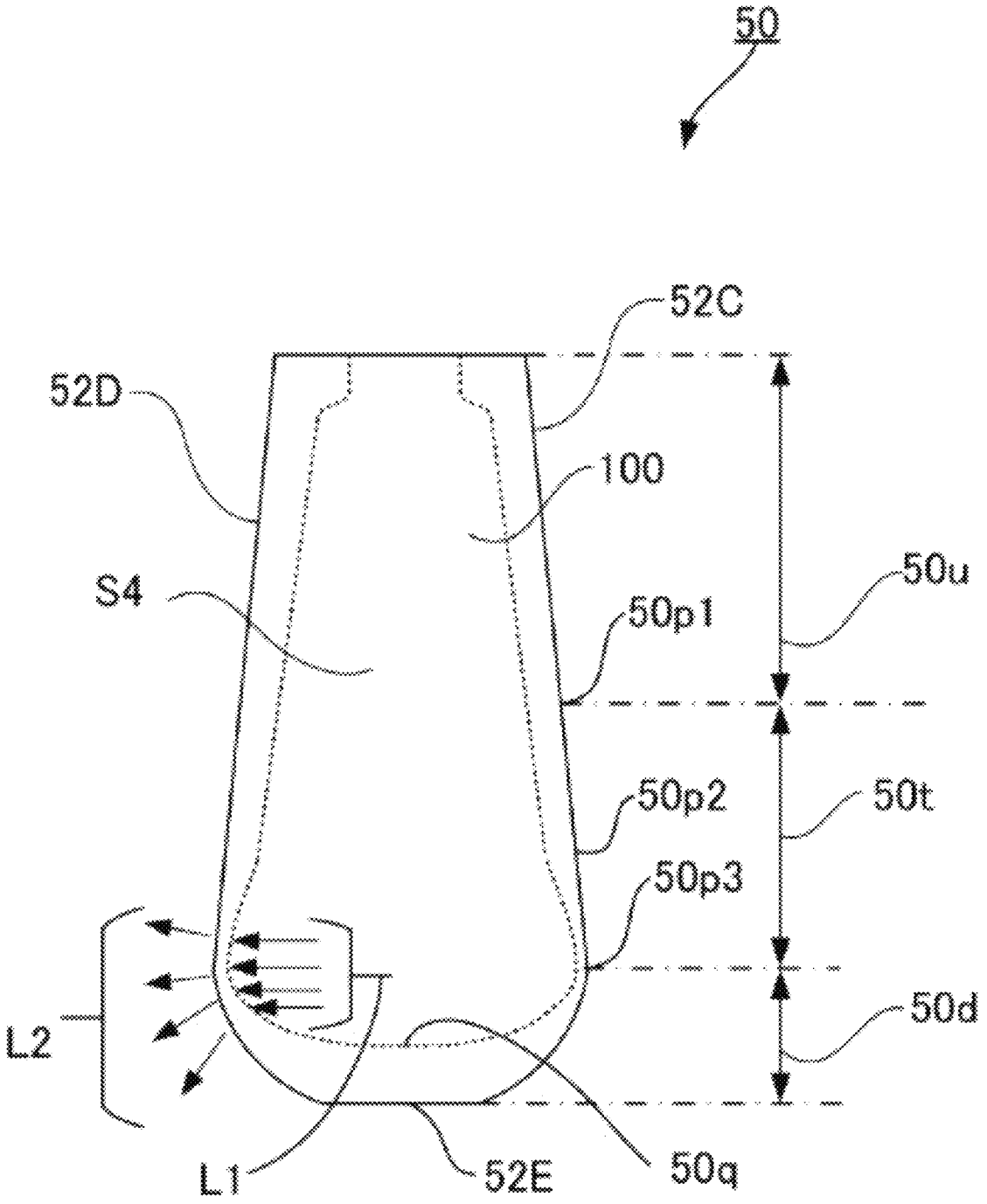
FIG. 13 is a schematic front view illustrating the refractive state of the image of the cosmetic material held in the container body.
Figure 14:
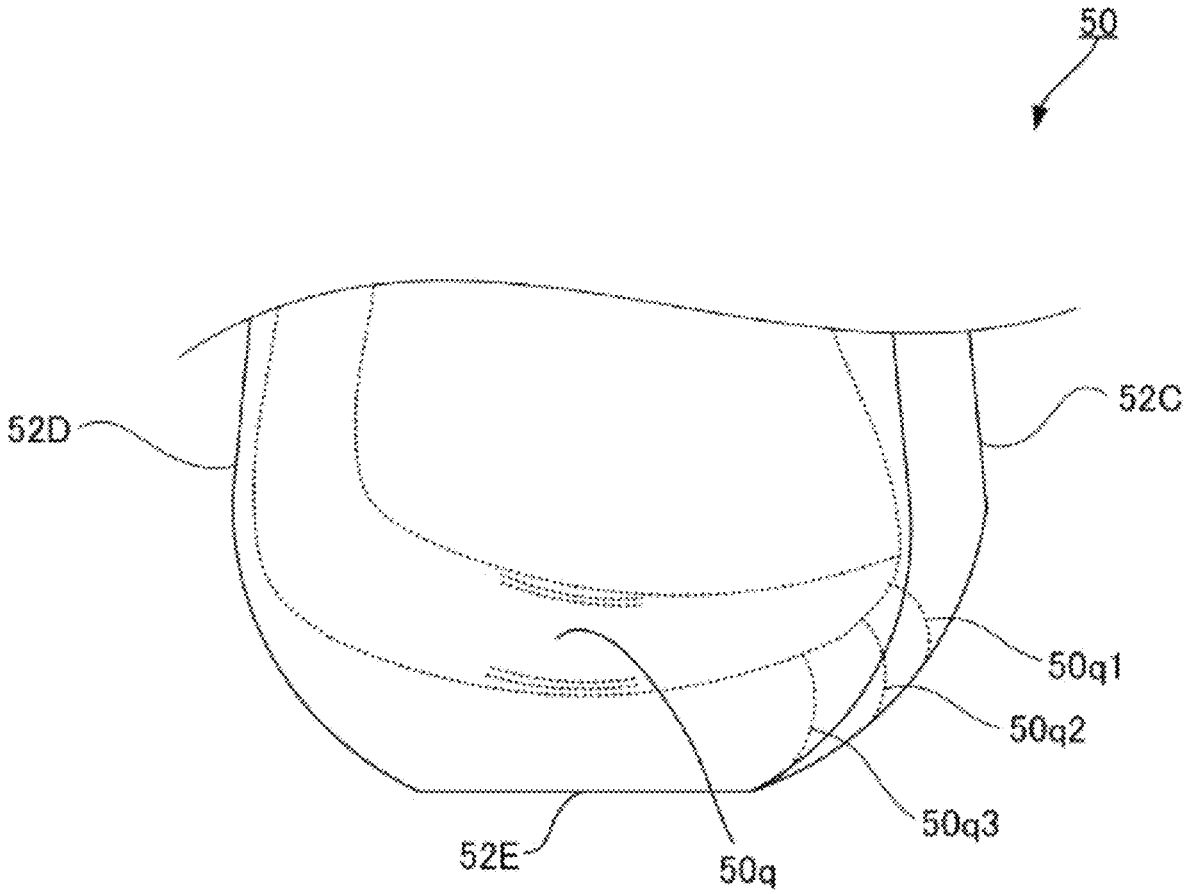
FIG. 14 is an enlarged perspective view of the bottom of the container body.
Figure 15:
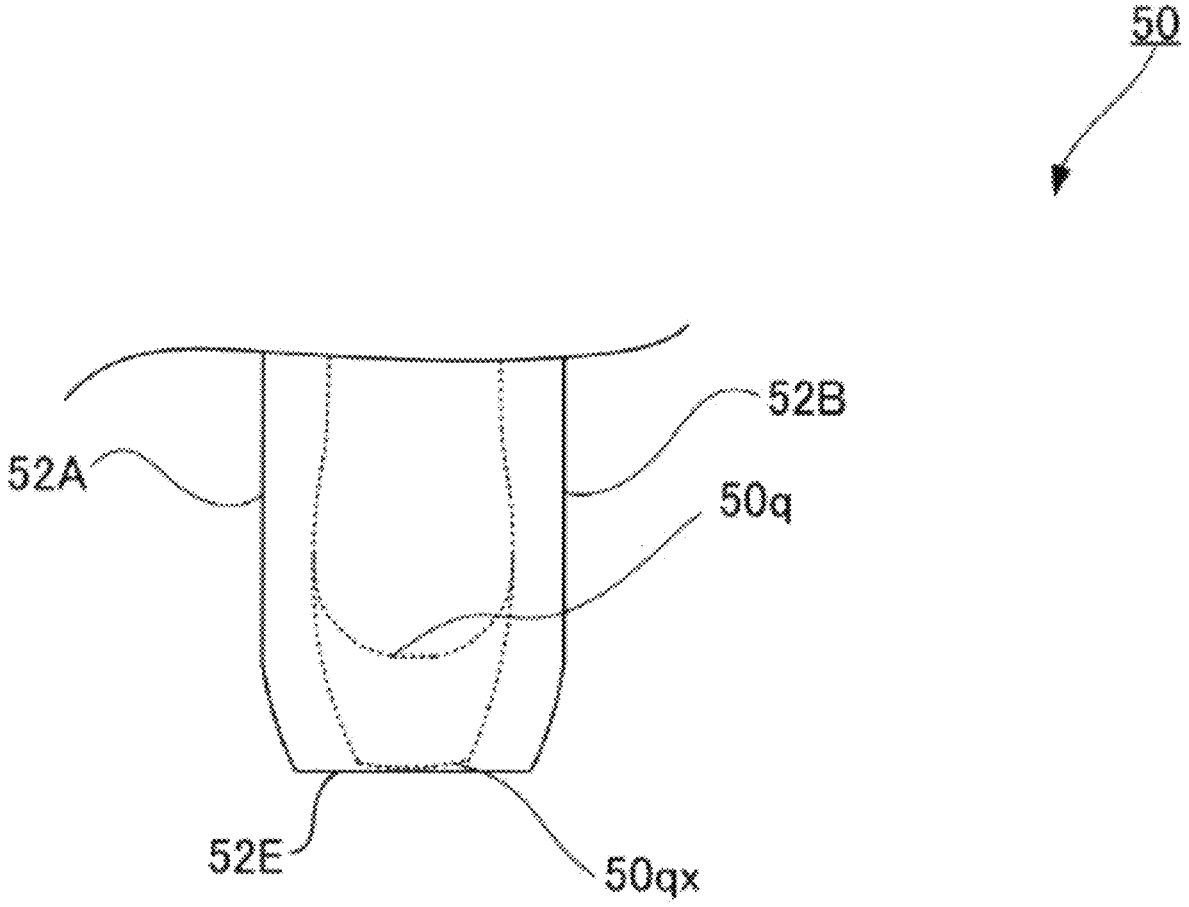
FIG. 15 is an enlarged side view of the bottom of the container body.
Figure 16:
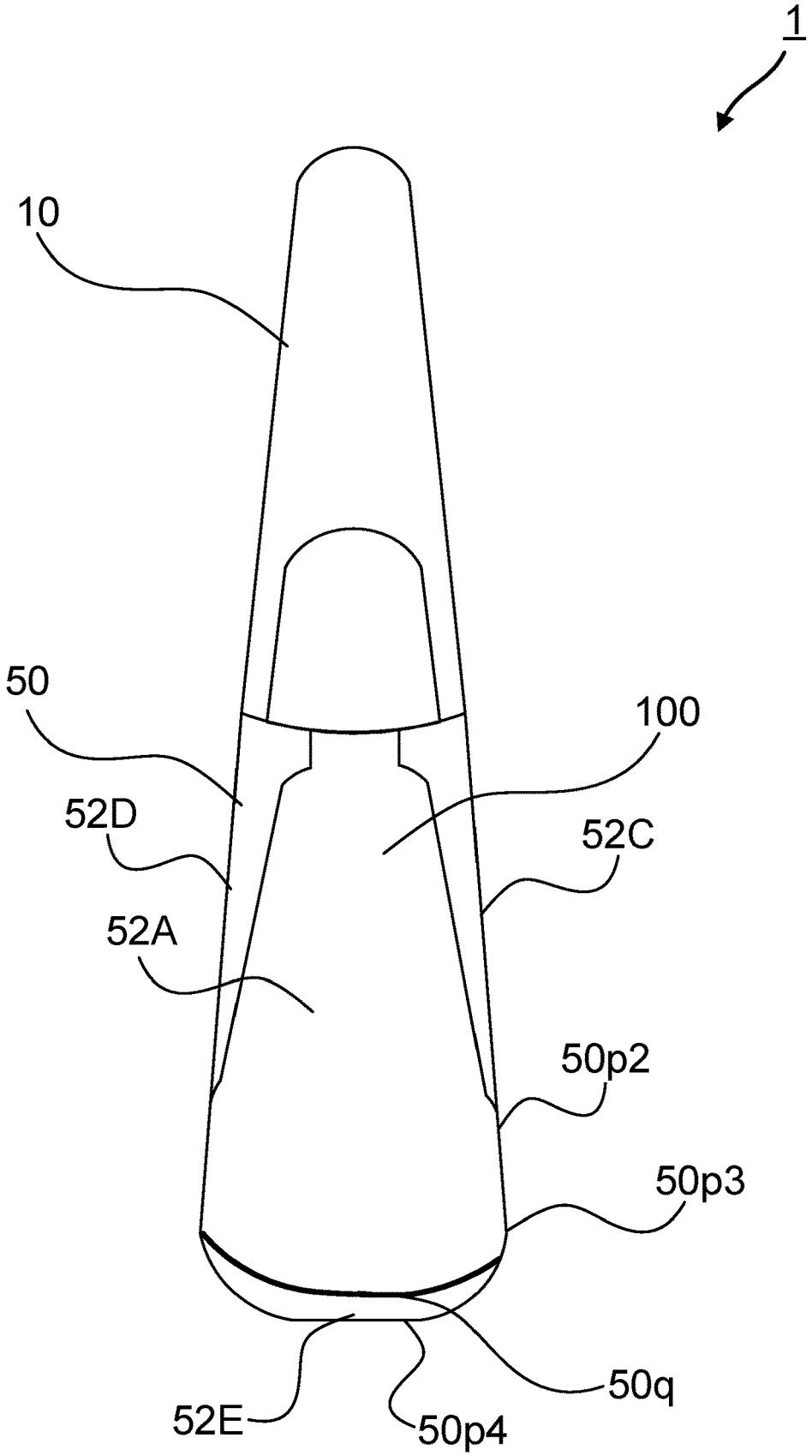
FIG. 16 is a front view of an embodiment of the present invention in a state where lip gloss is held therein.

Hereinafter, the state when the cosmetic material 100 is held in the container 1 will be described. As illustrated in FIG. 13, by forming the main body lower portion 50$d$ in the aforementioned curved shape, the light indicating the image of the cosmetic material 100 held in the inner space S4 of the container 1 is diffused in the directions (particularly downward) indicated by the arrows L2 from the directions indicated by the arrows L1 in the vicinity of the main body lower portion 50$d$. As illustrated in FIG. 14, as the viewpoint of the user shifts from the front to the side, the lowermost point of the image of the cosmetic material 100 shifts downward from the position 50$q$ in the front to the positions 50$q$1, 50$q$2, and 50$q$3, and as illustrated in FIG. 15, in the side view, shifts to the position 50$qx$ which is extremely close to the lowermost portion of the bottom wall part 50E.

Next, an embodiment in which cosmetic material is held in the container 1 will be described while referencing FIGS. 16 to 19. In the front view of the container body 50 shown in FIG. 16, the main body upper portion 50$u$ and the main body middle portion 50$t$ are formed such that the transparent walls become gradually thinner from the upper side to the lower side of the container body 50, so that to the user the right side wall part 52C and the left side wall part 52D appear as an extremely elongated inverse triangle. The apex of the inverted triangle becomes near the position 50$p$2 of the main body middle portion 50$t$. Also, to the eye of the user, the cosmetic material 100 at the position 50$p$3 of the main body middle portion 50$t$ and the main body lower portion 50$d$ appears to diffuse and an effect is exhibited as if the right side wall part 52C and the left side wall part 52D did not exist. The cosmetic material 100 appears to the eye of the user down to the lowermost portion 50$q$ of the inner surface of the bottom wall part 52E, and the bottom wall part 52E having the thickness t1$e$ appears transparent down to the position 50$p$4.

Figure 17:
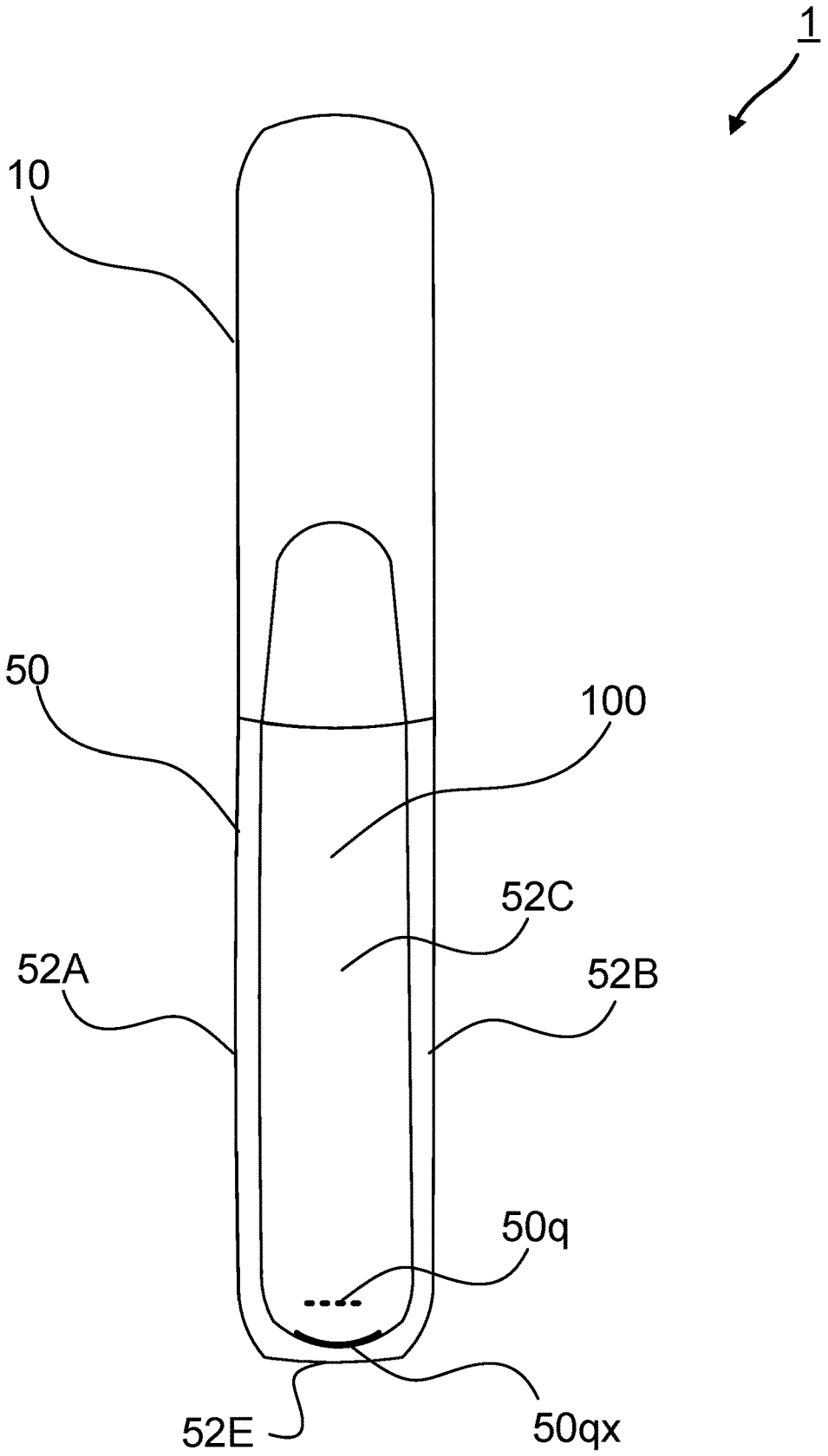
FIG. 17 is a side view of an embodiment of the present invention in a state where lip gloss is held therein.
Figure 18:
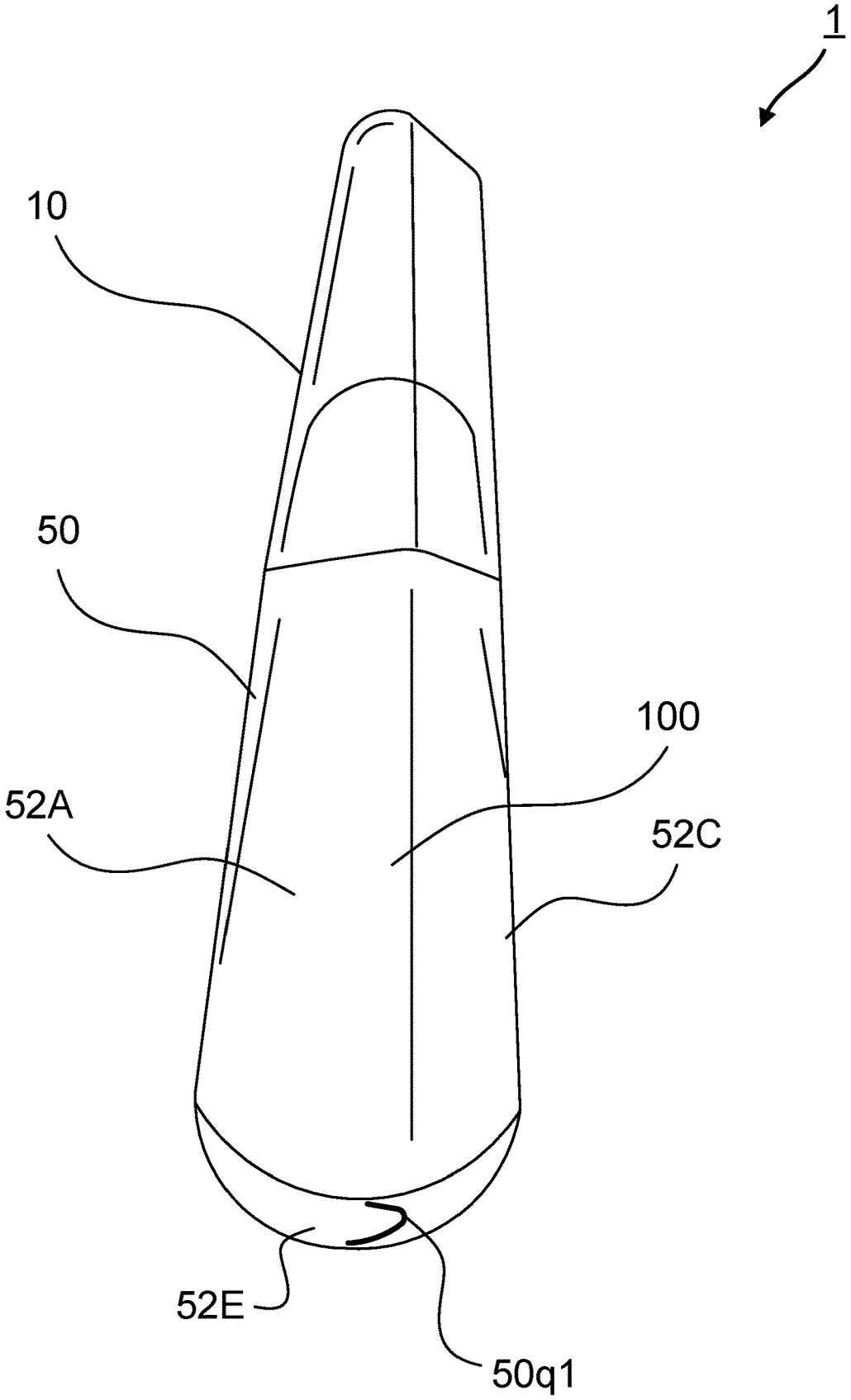
FIG. 18 is a perspective view of an embodiment of the present invention in a state where lip gloss is held therein.
Figure 19:
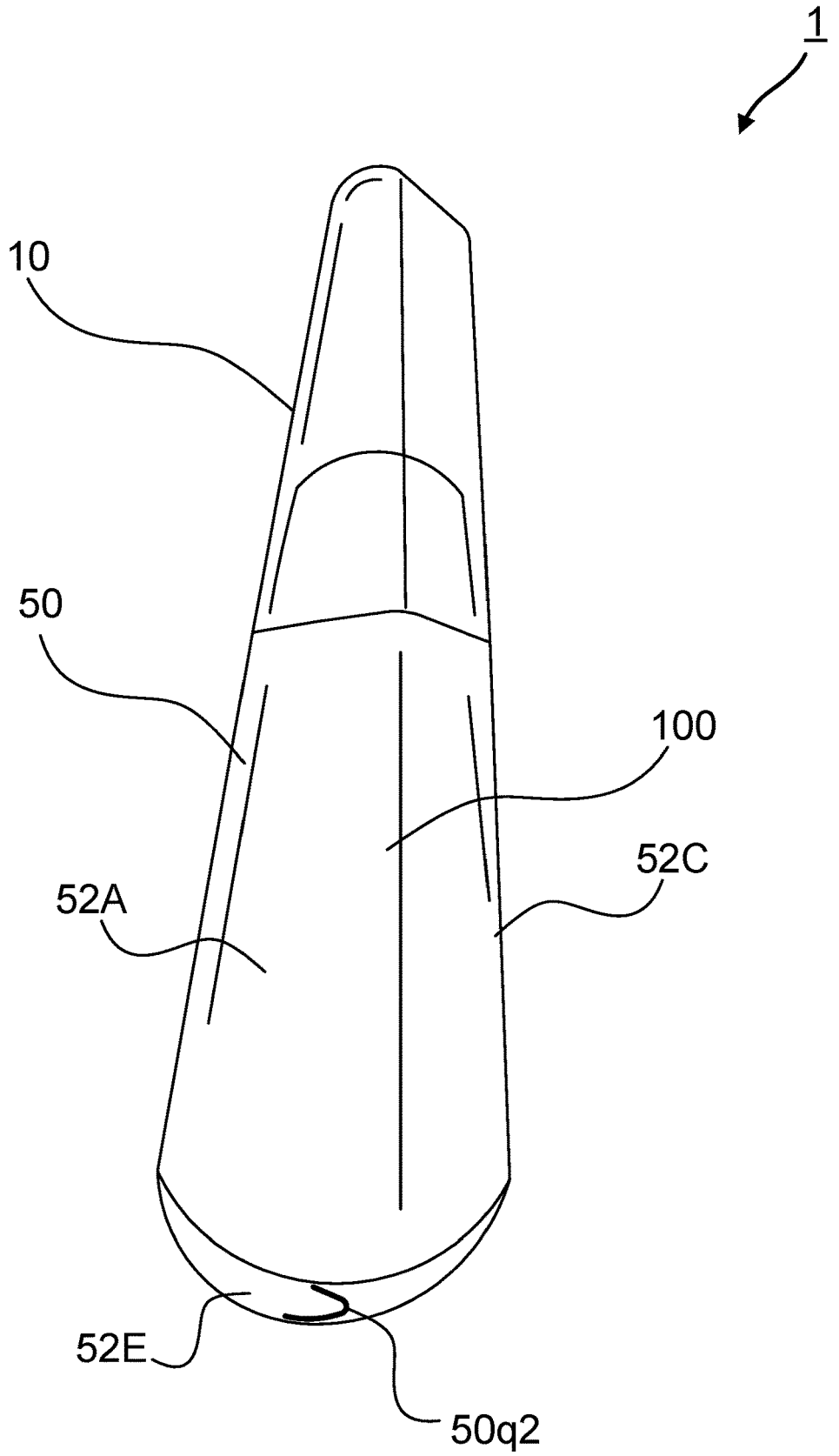
FIG. 19 is a perspective view of an embodiment of the present invention in a state where lip gloss is held therein.

In the side view of the container body 50 shown in FIG. 17, the transparent front wall part 52A and back wall part 52B become gradually thinner and appear to the user as an elongated inverse triangle. The apex of the elongated inverse triangle appears not to close. On the other hand, the cosmetic material 100 visible to the user can be seen down to the position 50$qx$ in the vicinity of the position 50$p$4 beyond the lowermost portion 50$q$ of the inner surface of the bottom wall part 52E where the cosmetic material is originally contained. This visual effect on the image of the cosmetic material 100 is due to the aforementioned shape of the main body lower portion 50*d*.

Next, structural strength and effects other than optical effects will be described. As illustrated in FIG. 14, since the inner surfaces of the main body lower portion 52*d* except for the lowermost portion 50*q* are formed as curved surfaces in both the front view and side view, and moreover, none of the corners are angles, even when the amount of the cosmetic material 100 held in the container becomes small, if the container 1 is stood upright, the cosmetic material 100 will shift to the lowermost portion 50*q* of the bottom wall part 52E through the force of gravity so that no cosmetic material 100 will get stuck in the corners. Then, when the user tilts the container 1, since the cosmetic material 100 will shift upward via the curved surface of the main body lower portion 52*d*, the cosmetic material 100 can be used without any waste.

In addition, since the area of the right side wall part 52C and the left side wall part 52D is small, it is not bulky when stored in a cosmetics pouch or the like. Furthermore, since the container 1 has an isosceles triangle shape, the flatness of the surface of the bottom wall part 52E enables it to stand on its own, so that it can be stood upright without falling over even when the amount of cosmetic material 100 becomes small.

The cosmetics container of the present invention is not limited to the above embodiment; various modifications can be made without departing from the summary of the present invention.

REFERENCE SIGNS LIST

1 Cosmetics container
10 Cap
20 Inner cap
50 Container body
70 Packing

What is claimed is:

1. A cosmetics container comprising:
a container body which holds a cosmetic material; and
a cap which engages with the container body,
wherein the container body includes:
a main body screw portion which engages with the cap;
a main body upper portion formed continuously below the main body screw portion;
a main body middle portion formed continuously below the main body upper portion; and
a main body lower portion formed continuously below the main body middle portion,
the main body upper portion, the main body middle portion and the main body lower portion form a front wall part, a back wall part, a right side wall part, a left side wall part, and a bottom wall part, which collectively form a space which holds the cosmetic material, wherein the right side wall part and the left side wall part defined by a shape of an inside of the container body are formed such that a thickness at the main body upper portion is thicker than a thickness at the main body middle portion,
wherein the cosmetics container:
is formed such that an area of the front wall part and the back wall part is greater than an area of the right side wall part and left side wall part;
is formed in a shape of an isosceles triangle having rounded corners, and having an uppermost portion of the cap as an apex and the bottom wall part as a bottom edge in a front view; and
is formed of a material where at least the container body has light permeability.

2. The cosmetics container according to claim 1, wherein:
a thickness of the right side wall part and the left side wall part gradually becomes thinner from a position on the main body screw portion towards a position on the main body middle portion.

3. The cosmetics container according to claim 1, wherein:
a thickness of the right side wall part and the left side wall part is configured so as to become thinner as it approaches the main body lower portion and has, in the main body middle portion, a thinning increase position where a rate at which the thickness of the right side wall part and the left side wall part becomes thinner increases.

4. The cosmetics container according to claim 3, wherein:
connecting portions between the main body middle portion and the main body lower portion are formed as thinmost portions where wall thickness is at its thinnest in the container body.

5. The cosmetics container according to claim 1, wherein the shape of the cosmetic container is rectangular with rounded corners in a side view.

6. The cosmetics container according to claim 1, wherein the cap comprises:
a front-face portion and a side-face portion, wherein the front-face portion of the cap is connected to the side-face portion and the front-face portion is curved along a top section; and
a bottom portion comprising an edge that defines an opening portion.

7. The cosmetic container according to claim 6, wherein the opening portion defines an opening space within the cap, and wherein an inner cap is fixed to an inner surface of the opening space within the cap.

8. The cosmetic container according to claim 7, wherein an outer surface of the inner cap comprises vertically elongated protrusions and horizontally elongated protrusions configured to engage with grooves formed in the inner surface of the cap.

9. The cosmetic container according to claim 1, wherein a latching projection of the main body upper portion detachably engages between inclined projections of the cap.

10. The cosmetic container according to claim 1, wherein a distance between inner surfaces of a middle portion of the main body upper portion is smaller than a distance between inner surfaces of left and right side walls of the main body upper portion in the cross-sectional view.

11. The cosmetic container according to claim 1, wherein a distance between inner surfaces of a middle portion of the main body middle portion is smaller than a distance between inner surfaces of left and right side walls of the main body middle portion in the cross-sectional view.

12. The cosmetic container according to claim 1, wherein a distance between inner surfaces of a middle portion of the main body lower portion is smaller than a distance between inner surfaces of left and right side walls of the main body lower portion in the cross-sectional view.

13. A cosmetics container comprising:
a container body which holds a cosmetic material; and
a cap which engages with the container body,
wherein the container body includes:
a main body screw portion which engages with the cap;

a main body upper portion formed continuously below the main body screw portion;

a main body middle portion formed continuously below the main body upper portion; and a main body lower portion formed continuously below the main body middle portion, the main body upper portion, the main body middle portion and the main body lower portion form a front wall part, a back wall part, a right side wall part, a left side wall part, and a bottom wall part, which collectively form a space which holds the cosmetic material, wherein the cosmetics container:

is formed such that an area of the front wall part and the back wall part is greater than an area of the right side wall part and left side wall part;

is formed in a shape of an isosceles triangle having rounded corners, and having an uppermost portion of the cap as an apex and the bottom wall part as a bottom edge in a front view; and is formed of a material where at least the container body has light permeability, and wherein the front wall part and the back wall part defined by a shape of an inside of the container body are formed such that portions connecting sideways to the right side wall part and the left side wall part in the main body lower portion are thinner than in the main body middle portion.

14. The cosmetics container according to claim 13, wherein:

the front wall part and the back wall part defined by a shape of an inside of the container body are formed such that degree of the main body middle part being thicker than the portions connecting sideways to the right side wall part and the left side wall part is configured so as to become bigger as it approaches the main body lower portion.

15. A cosmetics container comprising:

a container body which holds a cosmetic material; and a cap which engages with the container body, wherein the container body includes:

a main body screw portion which engages with the cap;

a main body upper portion formed continuously below the main body screw portion;

a main body middle portion formed continuously below the main body upper portion; and a main body lower portion formed continuously below the main body middle portion, the main body upper portion, the main body middle portion and the main body lower portion form a front wall part, a back wall part, a right side wall part, a left side wall part, and a bottom wall part, which collectively form a space which holds the cosmetic material, wherein the cosmetics container:

is formed such that an area of the front wall part and the back wall part is greater than an area of the right side wall part and left side wall part;

is formed in a shape of an isosceles triangle having rounded corners, and having an uppermost portion of the cap as an apex and the bottom wall part as a bottom edge in a front view; and is formed of a material where at least the container body has light permeability, and wherein the main body screw portion comprises a cylinder portion and a male screw, wherein the male screw is formed on the cylinder portion; and wherein a packing is configured to be disposed inside the main body screw portion, wherein the packing comprises a packing main body portion and a diametrical expansion portion.

16. The cosmetic container according to claim 15, wherein the diametrical expansion portion of the packing comprises an upper end portion and a lower end portion, wherein the diameter of the upper end portion is greater than the diameter of the lower end portion, and wherein the lower end portion of the diametrical expansion portion of the packing engages with an upper end portion of the cylinder portion of the main body screw portion.

17. The cosmetic container according to claim 15, wherein the packing is pressed against a vicinity of a ceiling of a space of the inner cap when the cap and the container body are engaged with each other, and wherein the packing is formed from a flexible resin material, and wherein the flexible resin material includes polyethylene.

* * * * *